US011192372B2

(12) United States Patent
Sung et al.

(10) Patent No.: US 11,192,372 B2
(45) Date of Patent: Dec. 7, 2021

(54) INK JET HEAD ASSEMBLY AND APPARATUS FOR PROCESSING A SUBSTRATE

(71) Applicant: Semes Co., Ltd., Cheonan-si (KR)

(72) Inventors: Boramchan Sung, Asan-si (KR); Myungjin Kim, Cheonan-si (KR)

(73) Assignee: Semes Co., Ltd., Cheonan-si (KR)

( * ) Notice: Subject to any disclaimer, the term of this patent is extended or adjusted under 35 U.S.C. 154(b) by 125 days.

(21) Appl. No.: 16/662,388

(22) Filed: Oct. 24, 2019

(65) Prior Publication Data

US 2020/0130354 A1 Apr. 30, 2020

(30) Foreign Application Priority Data

Oct. 31, 2018 (KR) ..... 10-2018-0131986

(51) Int. Cl.

| | |
|---|---|
| ***B41J 2/145*** | (2006.01) |
| *B41J 2/14* | (2006.01) |
| *B41J 29/02* | (2006.01) |
| *B41J 3/54* | (2006.01) |

(52) U.S. Cl.

CPC ..... *B41J 2/145* (2013.01); *B41J 2/14* (2013.01); *B41J 3/543* (2013.01); *B41J 29/02* (2013.01)

(58) Field of Classification Search

CPC ..... B41J 2/145; B41J 3/543; B41J 2/14; B41J 2202/14; B41J 2202/19; B41J 2202/20; B41J 2/14024; B41J 2002/14362; B41J 2/235; B41J 29/02

See application file for complete search history.

(56) References Cited

U.S. PATENT DOCUMENTS

2009/0195596 A1* 8/2009 Oka ..... B41J 19/145 347/37
2012/0007911 A1* 1/2012 Hagiwara ..... B41J 29/02 347/20

FOREIGN PATENT DOCUMENTS

KR 10-2017-0142608 A 12/2017
KR 10-2018-0021493 A 3/2018
KR 10-1885924 B1 9/2018

* cited by examiner

*Primary Examiner* — Henok D Legesse
(74) *Attorney, Agent, or Firm* — Daly Crowley Mofford & Durkee, LLP

(57) ABSTRACT

An apparatus for processing a substrate may include a stage on which a substrate is placed, an ink jet head assembly for discharging chemical liquid onto the substrate, and a gantry for holding the ink jet head assembly over the substrate on the stage. The ink jet head assembly may include an ink jet head for discharging the chemical liquid onto the substrate, a supporting member for holding the ink jet head, a fixing member being combined with supporting member to fix the supporting member to the fixing member, a protruding member disposed on the fixing member, and a receiving member provided in the supporting member to receive the protruding member.

14 Claims, 3 Drawing Sheets

INK JET HEAD ASSEMBLY AND APPARATUS FOR PROCESSING A SUBSTRATE

CROSS-REFERENCE TO RELATED APPLICATION

This application claims priority to Korean Patent Application No. 10-2018-0131986 filed on Oct. 31, 2018 in the Korean Intellectual Property Office (KIPO), the contents of which are herein incorporated by reference in its entirety.

BACKGROUND

1. Field

Example embodiments of the invention relate to an ink jet head assembly and an apparatus for processing a substrate. More particularly, example embodiments of the invention relate to an ink jet head assembly capable of discharging chemical liquid onto a substrate, and an apparatus for processing a substrate including the ink jet head assembly.

2. Related Technology

In processes for manufacturing a display device such as a liquid crystal display device or an organic light emitting display device, a printing process for coating chemical liquid onto a substrate is performed to form an orientation film or a color filter on the substrate. The printing process can usually carried out using an ink jet head which can discharge the chemical liquid onto the substrate.

The ink jet head is disposed on a supporting member referred to as a head pack. The supporting member having the ink jet head thereon is combined with a fixing member referred to as a pack holder. When the ink jet head is replaced with a new ink jet head, the supporting member is separated from the fixing member, and then the supporting member having a new ink jet head thereon is combined with the fixing member. In this case, the new ink jet head disposed on the supporting member may deviate from a desired position because the supporting member and the fixing member is combined using a screw. Therefore, the time for adjusting the position of the new ink jet head may be increased, the time for the replacement of the ink jet head may also be increased, and a separate zig may be required to adjust the position of the new ink jet head.

SUMMARY

It is one object of the invention to provide an ink jet head assembly capable of exactly placing an ink jet head at a desired position.

It is another object of the invention to provide an apparatus for processing a substrate including the ink jet head assembly capable of exactly placing an ink jet head at a desired position According to an aspect of the invention, there is provided an ink jet head assembly which may include an ink jet head for discharging chemical liquid onto a substrate, a supporting member for holding the ink jet head, a fixing member being combined with supporting member to fix the supporting member to the fixing member, a protruding member disposed on the fixing member, and a receiving member provided in the supporting member to receive the protruding member.

In example embodiments, the receiving member may be provided at each end portion of the supporting member and the protruding member may be disposed on an upper face of the fixing member.

In example embodiments, the protruding member may have a tapered structure and the receiving member may have a tapered hole structure.

In some example embodiments, the protruding member may have protruding portion or a recessed portion, and an inside of the receiving member may contact the protruding portion of the protruding member or other portions of the protruding member except the recessed portion when the protruding member is inserted into the receiving member.

In some example embodiments, the ink jet head assembly may additionally include a first through hole formed in a central portion of the protruding member, a second through hole formed in a central portion of the receiving member and connected to the first through hole, a first connection hole formed in the fixing member and connected to the first through hole, a second connection hole formed in the supporting member and connected to the second through hole, and a coupling member inserted into the second connection hole, the second through hole, the first through hole and the first connection hole when the supporting member is combined with the fixing member.

In some example embodiments, the ink jet head assembly may additionally include a bush inserted into the receiving member in which the bush may contact the protruding member when the protruding member is inserted into the receiving member.

According to another aspect of the invention, there is provided an apparatus for processing a substrate which may include a stage on which a substrate is placed, an ink jet head assembly for discharging chemical liquid onto the substrate, and a gantry for holding the ink jet head assembly over the substrate on the stage. The ink jet head assembly may include an ink jet head for discharging the chemical liquid onto the substrate, a supporting member for holding the ink jet head, a fixing member being combined with supporting member to fix the supporting member to the fixing member, a protruding member disposed on the fixing member, and a receiving member provided in the supporting member to receive the protruding member.

In example embodiments, the protruding member may have a tapered structure and the receiving member may have a tapered hole structure.

In some example embodiments, the protruding member may have protruding portion or a recessed portion, and an inside of the receiving member may contact the protruding portion of the protruding member or other portions of the protruding member except the recessed portion when the protruding member is inserted into the receiving member.

In some example embodiments, the apparatus for processing a substrate may additionally include a first through hole formed in a central portion of the protruding member, a second through hole formed in a central portion of the receiving member and connected to the first through hole, a first connection hole formed in the fixing member and connected to the first through hole, a second connection hole formed in the supporting member and connected to the second through hole, and a coupling member inserted into the second connection hole, the second through hole, the first through hole and the first connection hole when the supporting member is combined with the fixing member.

In some example embodiments, the apparatus for processing a substrate may additionally include a bush inserted into the receiving member in which the bush may contact the protruding member when the protruding member is inserted into the receiving member.

According to example embodiments, the ink jet head assembly may exactly dispose the ink jet head at a desired position over a substrate in a printing process, and the ink jet head may not deviate from the desired position when the ink jet head is replaced with a new ink jet head. Further, the time for the replacement of the ink jet head may be reduced and a separate zig may not be required. Accordingly, the ink jet head assembly may provide exactly chemical liquid onto the substrate in the printing process and the maintenance of the ink jet head assembly may be more easily accomplished.

BRIEF DESCRIPTION OF THE DRAWINGS

Example embodiments will be more clearly understood from the following detailed description taken in conjunction with the accompanying drawing. The following figures represent non-limiting, example embodiments as described herein.

DESCRIPTION OF EMBODIMENTS

Figure 1:
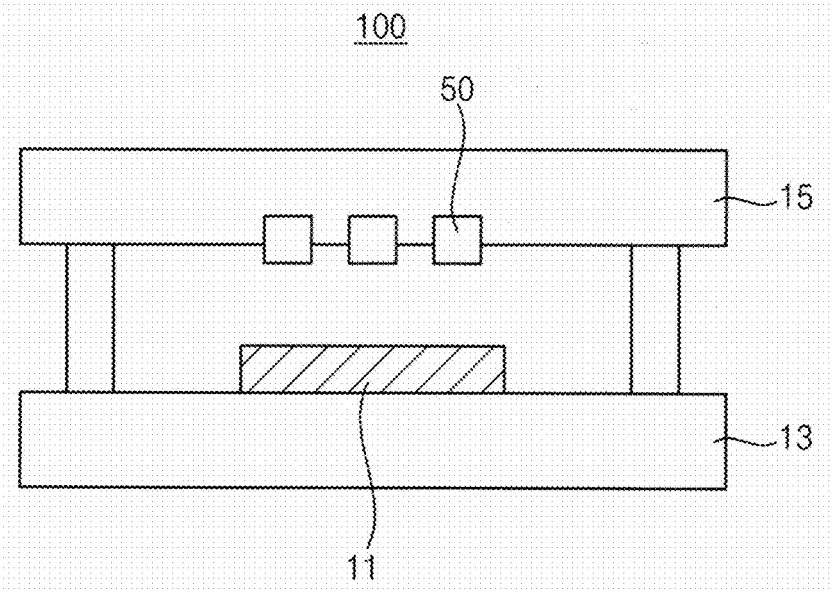
FIG. 1 is a schematic illustrating an apparatus for processing a substrate in accordance with example embodiments of the invention.

Various embodiments will be described more fully hereinafter with reference to the accompanying drawings, in which some embodiments are shown. The invention may, however, be embodied in many different forms and should not be construed as limited to the embodiments set forth herein. Rather, these embodiments are provided so that this description will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (for example, rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include a plurality of forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the face through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, it will be described an ink jet head assembly and an apparatus for transferring a substrate including an ink jet head assembly according to example embodiments with reference to the accompanying drawings.

FIG. 1 is a schematic illustrating an apparatus for processing a substrate in accordance with example embodiments of the invention.

Referring to FIG. 1, an apparatus for processing a substrate 100 according to example embodiments may be used in processes for manufacturing a display device such as a liquid crystal display device, an organic light emitting display device, etc. In example embodiments, the apparatus for processing a substrate 100 may be used in a printing process in which predetermined chemical liquid is provided onto a substrate 11 for manufacturing the display device. For example, the apparatus for processing a substrate 100 may be used in a printing process of forming an orientation film on the substrate 11 for manufacturing the liquid crystal display device. Alternatively, the apparatus for processing a substrate 100 may be employed in a printing process of forming a color filter on the substrate 11 for manufacturing the organic light emitting display device.

According to example embodiments, the apparatus for processing a substrate 100 may include a stage 13, an ink jet head assembly 50, a gantry 15, etc.

The substrate 11 may be mounted on the stage 13. The stage 13 may have an area substantially greater than an area of the substrate 11. For example, the stage 13 may have a rectangular plate shape. The stage 13 may be rotated while the substrate 11 is placed on the stage 13. In example embodiments, the apparatus for processing a substrate 100 may include a driving member (not illustrated) such as a motor in order to rotate the stage 13. In some example embodiments, the apparatus for processing a substrate 100 may include a heating member (not illustrated) such as a heater in order to heat the stage 13 to a predetermined temperature.

As illustrated in FIG. 1, the gantry 15 may hold the ink jet head assembly 50 at a desired position. Particularly, the gantry 15 may allow the ink jet head assembly 50 to locate over the substrate 11 plated on the stage 13. Thus, the ink jet head assembly 50 held by such gantry 15 may exactly provide the chemical liquid onto the substrate 11 in the printing process.

Figure 2:
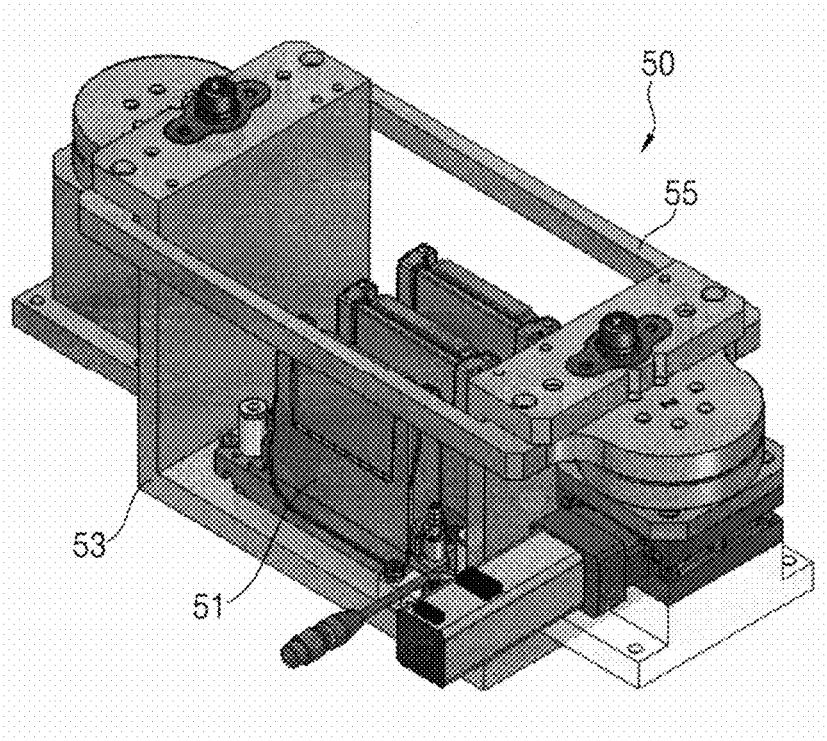
FIG. 2 is a perspective view illustrating an ink jet head assembly in accordance with example embodiments of the invention.

FIG. 2 is a perspective view illustrating an ink jet head assembly in accordance with example embodiments of the invention.

Referring to FIG. 1 and FIG. 2, an ink jet head assembly 50 according to example embodiments may include ink jet heads 51, a supporting member 53 and a fixing member 51.

In example embodiments, each of the ink jet heads 51 may include a plurality of nozzles which can discharge the chemical liquid onto the substrate 11 while the printing process is performed on the substrate 11. For example, one ink jet head 51 may have about one hundred and twenty-eight nozzles or about two hundred and fifty-six nozzles. In this case, the plurality of nozzles may be arranged in a substantially linear configuration by a predetermined distance. However, the number of the nozzles may vary in accordance with the size of the substrate 11.

The supporting member 53 may support the ink jet heads 51 and also may be referred to as a head pack. The ink jet heads 51 may be arranged on the supporting member 53 by a predetermined distance. The supporting member 53 may hold a plurality of ink jet heads 51. For example, three ink jet heads 51 may be arranged on the supporting surface of the supporting member 53 by the pack. In example embodiments, the supporting member 53 may have a central portion, lateral portions and end portions in which the central portion can be substantially flat, each of the lateral portions may extend substantially vertically from the central portion, and each of the end portions may be extend substantially horizontally from the each of the lateral portions. For example, each of the end portions of the supporting member 53 may bend from each of the lateral portions of the supporting member 53 at a right angle. Here, the ink jet heads 51 may be disposed on the central portion of the supporting member 53 and the lateral portions of the supporting member 53 may be spaced apart from the ink jet heads 51.

The fixing member 55 may be combined with the supporting member 53 such that the supporting member 53 may be fixed in accordance with the combination of the fixing member 55 and the supporting member 53. The fixing member 55 may be referred to as a pack holder. In example embodiments, the fixing member 55 may have a frame shape and the supporting member 53 may be inserted into such a fixing member 55 of the frame shape, thereby fixing the supporting member 53 to the fixing member 55. For example, as illustrated in FIG. 2, the supporting member 53 may be inserted into the fixing member 55 such that a bottom face of each end portion of the supporting member 53 may contact an upper face of the fixing member 55 having the frame shape. Thus, the supporting member 53 ma combined with the fixing member 55.

The ink jet heads 51 can be consumed while performing the printing process on the substrate 11, the ink jet heads 51 may be replaced with new ink jet heads after the printing process. In example embodiments, the ink jet heads 51 and the supporting member 53 may be simultaneously replaced with new ink jet heads and a new supporting member, respectively. In this case, the supporting member 53 having the ink jet heads 51 thereon may be separated from the fixing member 55, and then the new supporting member having the new ink jet heads thereon may be combined with the fixing member 55 as described above.

When the ink jet heads 51 are replaced with the new ink jet heads, the new ink jet heads may deviate from the desired position if the new supporting member is not fixed exactly to a desired portion of the fixing member 55, such that the new ink jet heads may not exactly provide the chemical liquid onto the substrate 11 in the printing process. Therefore, the new supporting member should be fixed to the desired portion of the fixing member 55. In example embodiments, the ink jet head assembly 50 may include means for exactly fixing the supporting member 53 to the desired portion of the fixing member 55.

Hereinafter, it will be described an ink jet head assembly including means for fixing a supporting member in accordance with example embodiments of the invention.

Figure 3:
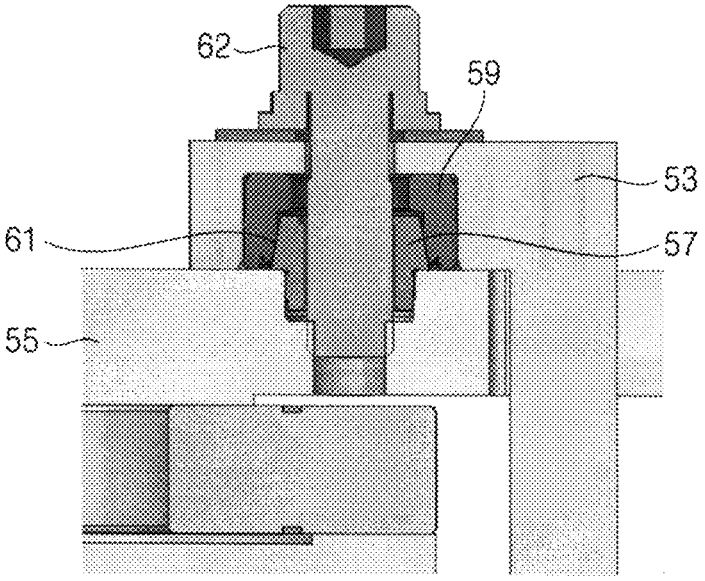
FIG. 3 is a cross sectional view illustrating a combined configuration of a supporting member and a fixing member included in the ink jet head assembly in accordance with example embodiments of the invention.

FIG. 3 is a cross sectional view illustrating a combined configuration of a supporting member and a fixing member included an ink jet head assembly in accordance with example embodiments of the invention.

Referring to FIG. 3, the ink jet head assembly 50 according to example embodiments may include a protruding member 57 and a receiving member 61 as the means for fixing a supporting member 53 to a desired portion of a fixing member 55.

As described above, the supporting member 53 may be combined with the fixing member 55 such that the bottom face of each end portion of the supporting member 53 may be contacted with the upper face of the fixing member 55 having the frame shape. In example embodiments, the protruding member 57 may be disposed on the fixing member 55 and the receiving member 61 may be provided in each end portion of the supporting member 53. The protruding member 57 may protrude upwardly from the upper face of the fixing member 55. The protruding member 57 disposed on the upper face of the fixing member 55 may be inserted into the receiving member 61 provided in each end portion of the supporting member 55. For example, the protruding member 57 may have a pin shape which can be partially inserted in the fixing member 55.

Hereinafter, it will be described an ink jet head assembly including a protruding member in accordance with example embodiments of the invention.

Figure 4:
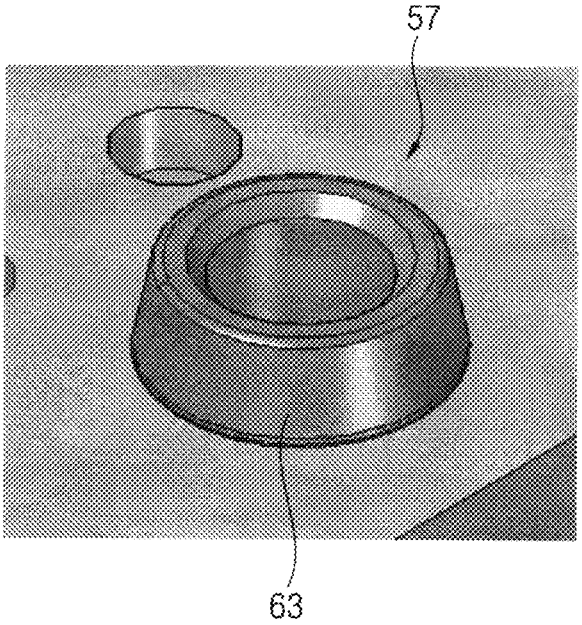
FIG. 4 is a perspective view illustrating a protruding member included in the ink jet head assembly in accordance with example embodiments of the invention.
Figure 5:
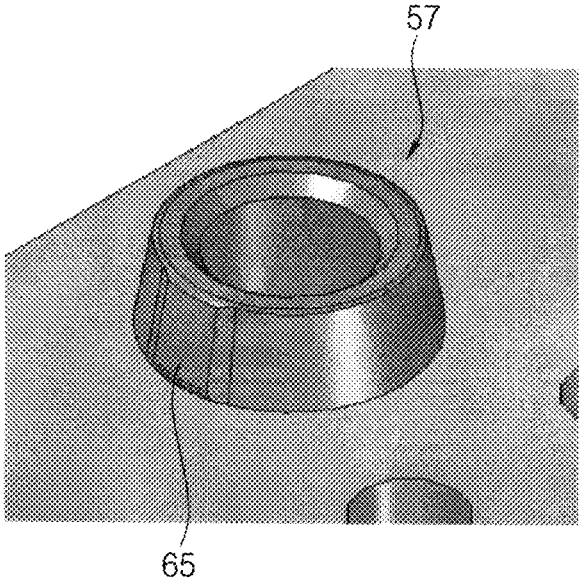
FIG. 5 is a perspective view illustrating a protruding member included in the ink jet head assembly in accordance with some example embodiments of the invention.

FIG. 4 is a perspective view illustrating a protruding member included in the ink jet head assembly in accordance with example embodiments of the invention. FIG. 5 is a perspective view illustrating a protruding member included in the ink jet head assembly in accordance with some example embodiments of the invention.

Referring to FIG. 3 and FIG. 4, the protruding member 57 of the ink jet head assembly 50 may have a tapered structure 63 of which dimensions are gradually reduced upwardly. For example, the protruding member 57 may have a truncated cone structure. Alternatively, the protruding member 57 may have a truncated polypyramid structure.

As illustrated in FIG. 5, the protruding member 57 of the ink jet head assembly 50 may include a protruding portion 65 extending from a peripheral portion thereof. Here, the protruding member 57 may have the tapered structure 63 such as the truncated cone structure, or the truncated polypyramid structure. Alternatively, the protruding member 57 may include a plurality of protruding portions 65 separated from each other on the peripheral portion by a predetermined distance.

In other example embodiments, the protruding member 57 of the ink jet head assembly 50 may include a recessed portion (not illustrated) on the peripheral portion thereof. In this case, the protruding member 57 may have the tapered structure 63 such as the truncated cone structure, or the truncated polypyramid structure. Alternatively, the protruding member 57 may include a plurality of recessed portions (not illustrated) separated from each other on the peripheral portion by a predetermined distance.

In other example embodiments, the protruding member 57 may include both of the protruding portion 65 and the recessed portion. Further, the protruding member 57 may include the plurality of protruding portions 65 and the plurality of recessed portions. Each of the protruding portions 65 and the recessed portions may be spaced apart by the predetermined distance.

Referring now to FIG. 3, the receiving member 61 provided at each end portion of the supporting member 53 may correspond to the protruding member 57 formed on the upper face of the fixing member 55. The receiving member 61 may have dimensions greater than the dimensions of the protruding member 57 so as to accommodate the protruding member 57 therein. For example, the receiving member 61 may have a pin hole shape when the protruding member 57 has the pin shape.

In example embodiments, when the protruding member 57 has the tapered structure 63 as described above, the receiving member 61 may have a truncated cone-shaped hole structure, or a truncated polypyramid-shaped hole structure for receiving the protruding member 57.

As illustrated in FIG. 4, the protruding member 57 may include the protruding portion 65. Here, the inside of the receiving member 61 may be contacted with the protruding portion 65 of the protruding member 57 when the protruding member 57 is inserted into the receiving member 61.

As illustrated in FIG. 5, the protruding member 57 may include the recessed portion. In this case, the inside of the receiving member 61 may be contacted with other portion of the protruding member 57 except the recessed portion when the protruding member 57 is inserted into the receiving member 61.

In other example embodiments, the protruding member 57 may include the protruding portion 65 and the recessed portion. In this case, the inside of the receiving member 61 may be contacted with the protruding portion 65 of the protruding member 57 when the protruding member 57 is inserted into the receiving member 61.

According to example embodiments, the protruding member 57 may be combined with the receiving member 61 such that the supporting member 53 may be stably combined with the fixing member 55, and also the supporting member 53 may be exactly fixed to the desired portion of the fixing member 55. Therefore, the ink jet heads 51 disposed on the supporting member 53 may exactly provide the chemical liquid onto the substrate 11 in the printing process is performed. As a result, the time for the replacement of the ink jet heads 51 may be shortened, and the ink jet heads 51 may be placed at the desired position by the combination of the supporting member 53 and the fixing member 55 without a separate zig.

Referring now to FIG. 3, a first through hole may be provided in a central of the protruding member 57 and a second through hole may be provided in a central portion of the receiving member 61. Additionally, a first connection hole may be provided in the fixing member 55 and a second connection hole may be provided in the supporting member 53.

As a path from the supporting member 53 to the fixing member 55, the second connection hole, the second through hole, the first through hole and the first connection hole may be connected to one after another. In example embodiments, the ink jet head assembly 50 may include a coupling member 62 for more stably combining the supporting member 53 with the fixing member 55. The coupling member 62 may be inserted into the second connection hole of the supporting member 53, the second through hole of the receiving member 61, the first through hole of the protruding member 57 and the first connection hole of the fixing member 55. The supporting member 53 may be more stably fixed to the fixing member 55 by the coupling member 62, and thus the supporting member 53 may allow the ink jet heads 51 to exactly locate the desired position over the substrate 11 in the printing process.

In other example embodiments, the ink jet head assembly 50 may include a bush 59 which can be inserted into the receiving member 61. The bush 59 may contact the protruding member 57 received in the receiving member 61. With such bush 59, the protruding member 57 may be tightly combined with the receiving member 61. Therefore, the supporting member 53 may be more stably fixed to the fixing member 55 such that the ink jet heads 51 may be more precisely positioned at the desired position over the substrate 11 in the printing process.

According to example embodiments of the present invention, the apparatus for processing a substrate including the ink jet head assembly may be advantageously used in a process for coating chemical liquid on a substrate in order to form an orientation film or a color filter on the substrate in processes for manufacturing a display device.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. An ink jet head assembly comprising:

a fixing member having an opening formed therein, a supporting member that is inserted into the opening of the fixing member, an ink jet head disposed on the supporting member, a protruding member disposed on the fixing member;

a receiving member provided in the supporting member to receive the protruding member; and a coupling member that is inserted through a hole formed in the supporting member and a hole formed in the protruding member, the coupling member being received in a hole that is formed on the fixing member and arranged to couple the fixing member to the supporting member.

2. The ink jet head assembly of claim 1, wherein the protruding member has a tapered structure and the receiving member has a tapered hole structure.

3. The ink jet head assembly of claim 2, wherein the protruding member has a protruding portion or a recessed portion, and an inside of the receiving member contacts the protruding portion of the protruding member or other portions of the protruding member except the recessed portion when the protruding member is inserted into the receiving member.

4. The ink jet head assembly of claim 1, further comprising, wherein the ink jet head is positioned entirely below the fixing member.

5. The ink jet head assembly of claim 1, wherein the supporting member is partially inserted into the opening of the fixing member, and the supporting member includes an end portion that engages an upper surface of the fixing member.

6. An ink jet head assembly comprising,

An ink jet head for discharging chemical liquid into a substrate, a supporting member for holding the ink jet head;

a fixing member being combined with supporting member to fix the supporting member to the fixing member, a protruding member disposed on the fixing member;

a receiving member provided in the supporting member to receive the protruding member;

a first through hole formed in a central portion of the protruding member;

a second through hole formed in a central portion of the receiving member and connected to the first through hole, a first connection hole formed in the fixing member and connected to the first through hole;

a second connection hole formed in the supporting member and connected to the second through hole; and a coupling member inserted into the second connection hole, the second through hole, the first through hole and the first connection hole when the supporting member is combined with the fixing member.

7. The ink jet head assembly of claim 1, further comprising a bushing inserted into the receiving member wherein the bushing contacts the protruding member when the protruding member is inserted into the receiving member.

8. An apparatus for processing a substrate, comprising:

a stage on which a substrate is placed;

an ink jet head assembly for discharging chemical liquid onto the substrate; and a gantry for holding the ink jet head assembly over the substrate on the stage, the ink jet head assembly comprising:

a fixing member having an opening formed therein, a supporting member that is inserted into the opening of the fixing member;

an ink jet head disposed on the supporting member, the ink jet head being positioned entirely below the fixing member, a protruding member disposed on the fixing member; and a receiving member provided in the supporting member to receive the protruding member.

9. The apparatus of claim 8, wherein the protruding member has a tapered structure and the receiving member has a tapered hole structure.

10. The apparatus of claim 9, wherein the protruding member has a protruding portion or a recessed portion, and an inside of the receiving member contacts the protruding portion of the protruding member or other portions of the protruding member when the protruding member is inserted into the receiving member.

11. The apparatus of claim 8, wherein the ink jet head assembly further comprises, a first through hole formed in a central portion of the protruding member;

a second through hole formed in a central portion of the receiving member and connected to the first through hole, a first connection hole formed in the fixing member and connected to the first through hole, a second connection hole formed in the supporting member and connected to the second through hole; and a coupling member inserted into the second connection hole, the second through hole, the first through hole and the first connection hole when the supporting member is combined with the fixing member.

12. The apparatus of claim 8, further comprising a bushing inserted into the receiving member wherein the bushing contacts the protruding member when the protruding member is inserted into the receiving member.

13. The apparatus of claim 8, wherein the supporting member is partially inserted into the opening of the fixing member, and the supporting member includes an end portion that engages an upper surface of the fixing member.

14. The apparatus of claim 8, wherein the ink jet head assembly further comprises a coupling member that is inserted through a hole formed in the supporting member and a hole formed in the protruding member, the coupling member being received in a hole that is formed on the fixing member and arranged to couple the fixing member to the supporting member.

* * * * *